United States Patent [19]

Manning

[11] Patent Number: 4,873,923

[45] Date of Patent: Oct. 17, 1989

[54] HYDRAULIC PRESS PLATON SUPPORT

[76] Inventor: Douglas E. Manning, 7300 Rule Rd., Knoxville, Tenn. 37920

[21] Appl. No.: 239,040

[22] Filed: Aug. 29, 1988

Related U.S. Application Data

[63] Continuation-in-part of Ser. No. 864,294, May 16, 1986, abandoned.

[51] Int. Cl.[4] ..... B30B 1/08; B30B 1/34

[52] U.S. Cl. ..... 100/258 R; 100/46; 100/269 R

[58] Field of Search ..... 100/46, 258 A, 258 R, 100/269 R, 214, 295

[56] References Cited

U.S. PATENT DOCUMENTS 3,163,105 12/1964 Pearson ..... 100/258 R X
3,757,680 9/1973 Williams ..... 100/258 A X
4,273,037 6/1981 Ruebesam ..... 100/295 X

*Primary Examiner*—Peter Feldman

[57] ABSTRACT

A hydraulic press for compacting materials with a large platen area has a platen support comprising of four hydraulic cylinders, one at each corner of a rectangular or square shaped platen. The cylinders are supplied with near equal fluid flows from commercially available hydraulic flow dividers. When an off-centered platen loading is encountered, the cylinders will respond with a higher restraining force from the cylinders nearest the load with relatively small bending moments transferred to the cylinder rods. The resulting platen structural load resembles a beam supported with pinned connections. The resulting press capacity can be significantly higher than that achievable with guided type platen supports of similar costs where the bending moment is restrained by the stiffness of the guides.

2 Claims, 6 Drawing Sheets

HYDRAULIC PRESS PLATON SUPPORT

This is a continuation-in-part of Ser. No. 864,294, filed May 16, 1986, now abandoned.

BACKGROUND OF THE INVENTION

1. Field of the Invention

The present invention relates to a platen support for a hydraulic press, and more particularly to a square or rectangular shaped platen of large surface area.

2. Description of the Prior Art

A hydraulic press does useful work by applying pressure or force to material through means of a single or double acting hydraulic cylinder connected to a platen. The platen is sized according to the requirements of each individual press. During loading it can usually be expected that forces not on the platen geometric center will be encountered thus creating bending moments equal to the force times the distance to the geometric center. These bending moments are a major consideration in the press design as the press frame, cylinder rods, cylinder supports, as well as the platen, must structurally sustain the applied forces and bending moments due to off-centered loading. The bending moment becomes more significant as the platen surface area is increased.

A typical press design will have a single cylinder connected to the platen geometric center with the platen bending moments restrained by guides. For a square or rectangular platen, many presses use four round guides at each corner of the platen. These are typically precision machined to a good surface finish to allow bushings mounted on the platen to slide freely over the guides. The press frame is machined by boring in line the guide end connections and platen bushing connections so as to achieve the additional requirement that the guides be parallel with each other within the platen bushing clearance. Each guide must also be straightened within the platen bushing clearance or sized smaller to allow it to deflect as the platen moves on the guides. A means for guide lubrication is also required. This design has the disadvantage that the platen cannot easily be configured to enter an open top container such as a box.

Another typical design will use guides that move through the press frame within the area of the platen. For presses requiring precise platen movements these guides can be precision machined round rods that run through line bored bushings mounted on the press frame. The parallel and straightness requirements of the four post design above also apply to this design although as few as two guides may be used. For presses with less precise platen movements the guides may consist of greased slides that run over structural members such as channels or beams. Rollers are also used instead of slides depending on the particular application. The main purpose of the guides in either case is to restrain the bending moments generated by loading the platen off-center.

An improvement over the single cylinder design is noted in U.S. Pat. No. 4,273,037 which uses a cylinder at each end of the platen thus effectively reducing any moments encountered in the longitudinal axis of the platen. Moments perpendicular to this axis are again restrained by guides.

Many instances exist where the present invention offers advantages over press designs with the widely used moment restraining guides.

SUMMARY OF THE INVENTION

According to the present invention the bending moment problem is reduced by placing identical hydraulic cylinders at each of the four corners of a square or rectangular platen. The cylinders are activated simultaneously by a standard hydraulic power unit that supplies near equal flows to each cylinder through commercially available hydraulic flow dividers. When a off-centered load is encountered, the platen will tend to remain level (if mounted in a vertical stroke press) since a near equal amount of hydraulic fluid is supplied to each cylinder. The hydraulic pressure in the cylinders nearest the load will be higher than in the other cylinders. The primary platen restraint then consists of a force at each corner with the total of the four forces equal to the platen loading. The platen can be analyzed similar to a structural beam. With a rigid cylinder rod to platen connection, the bending moment transferred into the rod is a function of the relative stiffness of the platen to the cylinder rod. This has the advantage of having a smaller bending moment transferred to the cylinder rod if the rod is relatively small (less stiff). The platen stiffness matrix can easily be increased by adding structural members or increasing the plate thickness which will also tend to transfer smaller moments to the cylinder rod. The rod bending moments can be further reduced to near zero by using commercially available swivel type rod to platen connections, in which case the platen would structurally resemble a beam with pinned connections.

A problem arises in that the fluid flow from the available flow dividers is a function of their volumetric efficiency and pressure difference and can be expected to have a maximum flow difference on the order of five per cent for a good quality divider and more for less expensive flow dividers. In addition, the hydraulic fluid used will have a compressibility factor which is typically on the order of at least one per cent per thousand pounds/square inch (PSI). Thus if the described system is used on a platen with a typical fluid pressure of 3000 PSI, then it can be expected that one cylinder can have a stroke at least eight per cent higher than another which becomes a significant problem as the platen travel stroke is increased. This would ordinarily result in a bending of both the platen and rods.

The simplest way to implement the invention is to use rigid mounts on both the cylinder to frame mount and rod to platen connection and design the rod-platen system to deflect an amount expected by the flow divider and pressure used. Should a normally minor malfunction occur, such as failure of a hydraulic line or directional valve supplying either cylinder, then the other cylinders would continue to operate most probably causing major damage to the machine.

A more foolproof implementation is to use trunnion or pin mounted hydraulic cylinders which are further mounted in a universal joint type mount with an axis 90 degrees to the cylinder pin; this allows a swivel joint at the cylinder to frame mount. The swivel joint can be located at either end or along the cylinder depending on the configuration of the particular press frame. The rod to platen connection is also a commercially available swivel rod end. The cylinder swivel movement is restrained by mechanical stops which keep the platen from floating freely and in the envelope normally enclosed by a level (vertical stroke press) platen. This allows a line or valve failure to one cylinder with no damage to the machine and also the expected cylinder stroke difference can be taken with no significant bending transferred to the cylinder rods. This implementation also has the advantage that the cylinder rods do not have to run parallel, thus lowering the press fabrication costs. When double acting cylinders are used, the cylinders can be configured to either push or pull the platen against the work.

The primary advantage of the invention is to reduce the problem of transferring platen bending moments to the cylinder rods and frame, whichever way it is implemented, thus allowing higher press forces to be achieved, particularly with large area platens.

BRIEF DESCRIPTION OF DRAWINGS

In the drawings:

FIG. 4 is not taken from any other FIGS.

FIG. 8 is not taken from any other FIGS.

FIG. 10 is not taken from any other drawing figures.

DETAILED DESCRIPTION

Figure 1:
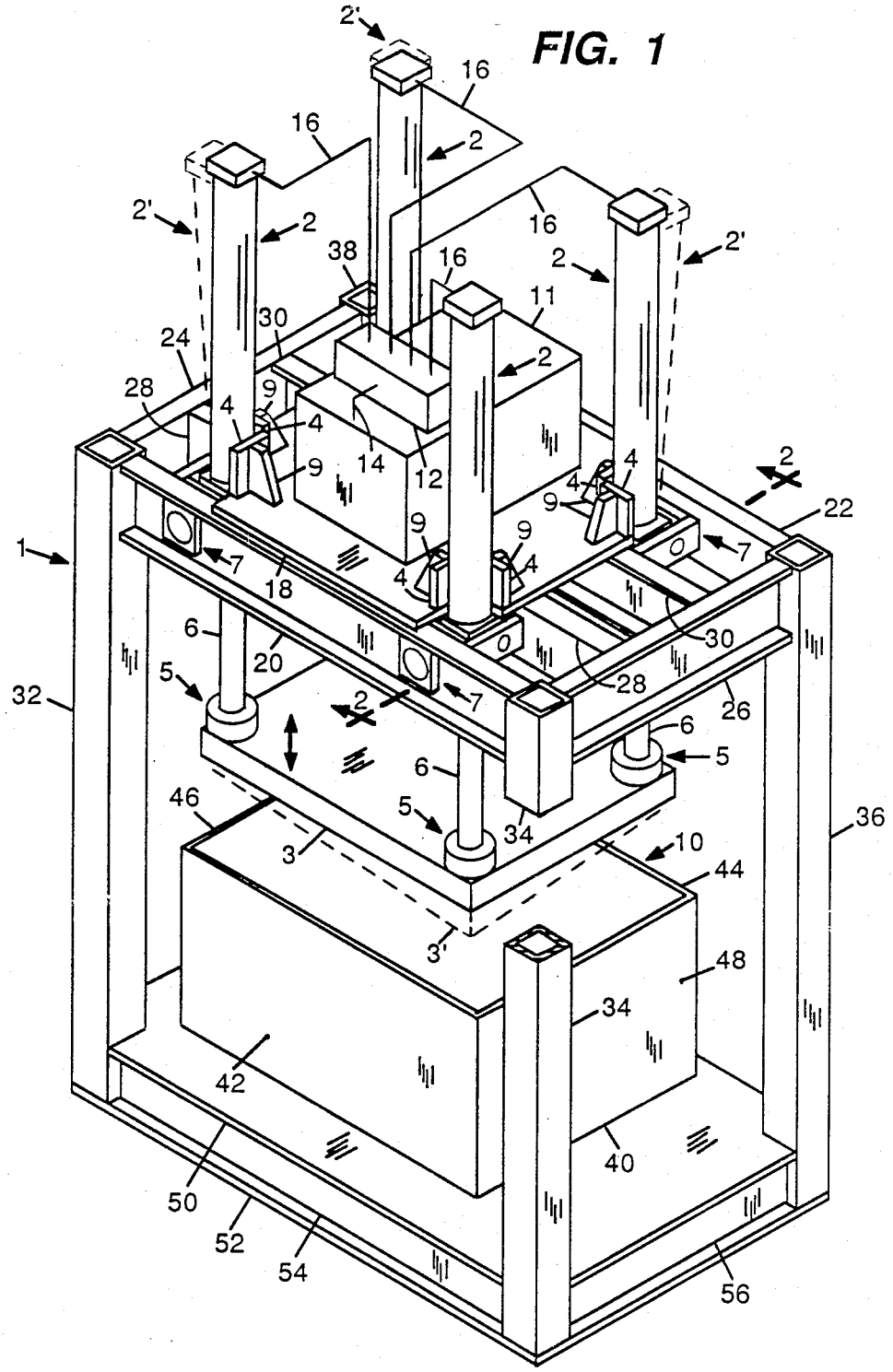
FIG. 1 is a front perspective view of a vertical stroke press using swivel type universal joint cylinder mounts and swivel rod end mounts. This configuration is used when the cylinders push the platen against the work.
Figure 2:
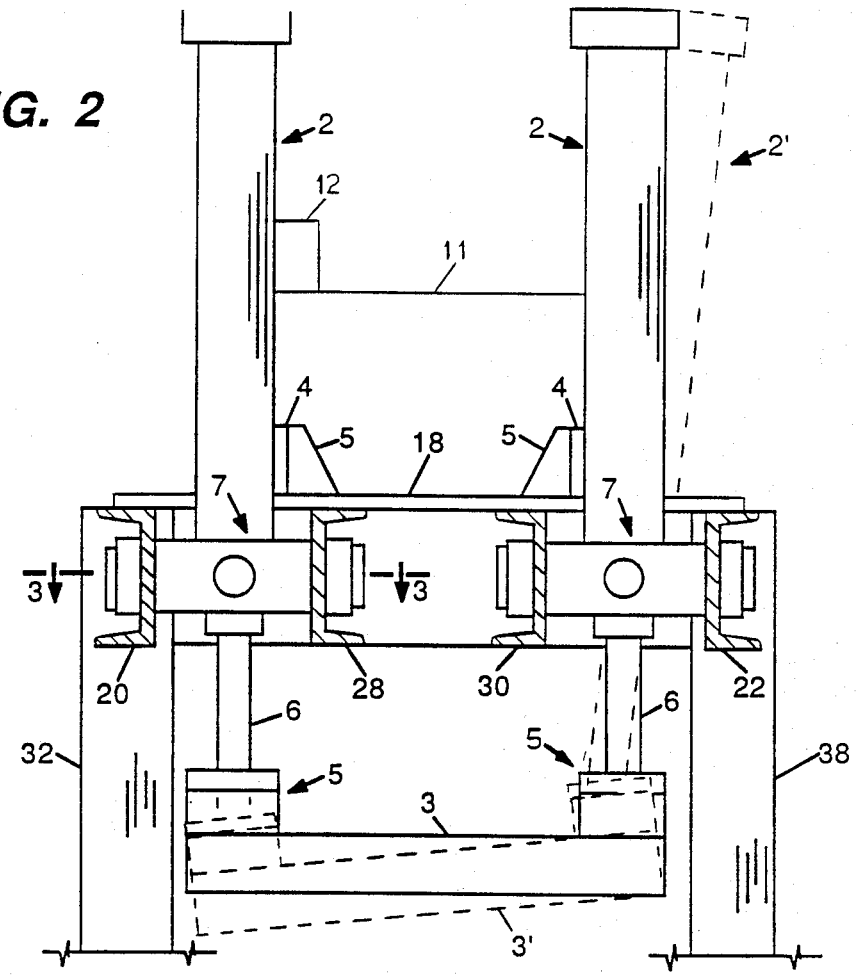
FIG. 2 is a sectional view taken from FIG. 1 and further shows a cylinder and platen condition should one cylinder fail to operate or a large unequal flow be encountered.

With reference to FIGS. 1–2 the present invention is implemented on a vertical push down stroke press with a rectangular platen 3. Four hydraulic cylinders 2 are swivel mounted to the press frame 1 using a universal joint type mount 7. The cylinders 2 are freely allowed to swivel from a vertical position against a mechanical stop 4 outward, as illustrated by the moved cylinder positions 21 within the swing limits of the universal joint 7. Each cylinder rod 6 is connected to the platen 3 through a commercially available ball and socket type swivel joint 5 or any other type of functionally equivalent swivel joint. The mechanical stop 4 prevents the platen 3 from moving outside of the envelope normally seen when the platen 3 is perpendicular to the stroke. The swivel joint connections allow pivotal movement in directions perpendicular to the longitudinal axis of the cylinders. When the cylinders 2 are supplied with equal hydraulic fluid volumes the platen 3 will travel its stroke and function as a platen restricted to its intended movement by very rigid guides.

In FIGS. 1–2 the press frame is illustrates as comprising members 18,20,22,24,26,28,30 connected to the uprights 32,34,36,38 and having a base 50,52,54,56. The mechanical stops 4 are stiffened by members 9 and attached to the frame member 18 by means such as welding or bolting. No specific means for attaching the press structural parts are illustrated but it is well known to use welding or bolting means to attach such members.

The press is operated by means of a hydraulic power unit 11 having pumping means for supplying pressurized hydraulic fluid through plumbing means 14 to a flow divider 12. The flow divider 12 in turn supplies near equal volumes of hydraulic fluid to each cylinder 2 through plumbing means 16. Return lines typically used to retract the cylinders are omitted from the illustrations for clarity. Single acting ram type cylinders having retracting means such as a spring may also be used with the present invention.

The press is operated with a standard remote hydraulic power unit 11 through a commercially available fluid flow divider 12. Flow from the divider is directed to each cylinder causing the cylinder rods 6 to extend and the platen 3 to move downward until the end of the stroke or a restraint indicating resistance is indicated by either a hydraulic relief valve or electrical pressure switch, both standard commercially available and typically used in press design and included as part of the power unit 11.

If the platen 3 is uniformly loaded or restrained with an object placed in the path of its stroke and symmetrical about the geometric center of the platen 3, then the hydraulic flow divider 12 will deliver flows to each cylinder 2 equal enough to cause the platen 3 to lower in a level attitude.

If the platen 3 is loaded or restrained at any point other than its geometric center then the hydraulic flow divider 12 will act as a pressure intensifier and deliver a higher hydraulic pressure to the cylinders nearest to the center of the restraining load. A characteristic of flow dividers is that they can deliver a pressure to any one output line that is higher than the delivered pump pressure if the remaining lines are lower than the delivered pump pressure. If such a divider could operate with no mechanical or thermal losses then the pressure on any one of four output lines could theoretically be four times the pressure delivered by the hydraulic pump if the other three lines were at zero pressure. An indication of the maximum allowable pressure to the cylinders 2 must as a consequence be monitored from each of the lines supplying pressurized fluid to the cylinders 2.

Another characteristic of the commercially available hydraulic flow dividers is that they will vary slightly from a true equal division of the supplied fluid flow by an amount characteristic of the pressure difference and volumetric efficiency of the particular type of divider used. When the platen is loaded off-center, this flow difference will result in a stroke difference among the cylinders 2. Accordingly, it becomes necessary to compensate for this difference. The swivel mounts 5,7 shown provide this compensation and also allow for a loss of flow to one cylinder 2 with minimum damage to the main press components. An exaggerated condition of the stroke difference due to unequal flow division is shown in FIGS. 1–2 by the dashed lines 2',3' which show positions of the platen 3 and cylinders 2 with unequal extension of the cylinder rods 6. It is also necessary to resyncronize the cylinders periodically, such as at the beginning of each stroke, by bypassing the flow divider with either a hydraulic relief valve or directional control valve incorporated with the hydraulic power unit 11. The invention implementation indicated by FIGS. 1–2 is very useful when the platen 3 is required to descend inside an open container such as a box compactor. A typical box container 10 is indicated by FIG. 1.

FIG. 1 as having an open top, sides 42,44,46,48 and a bottom 40.

Figure 3:
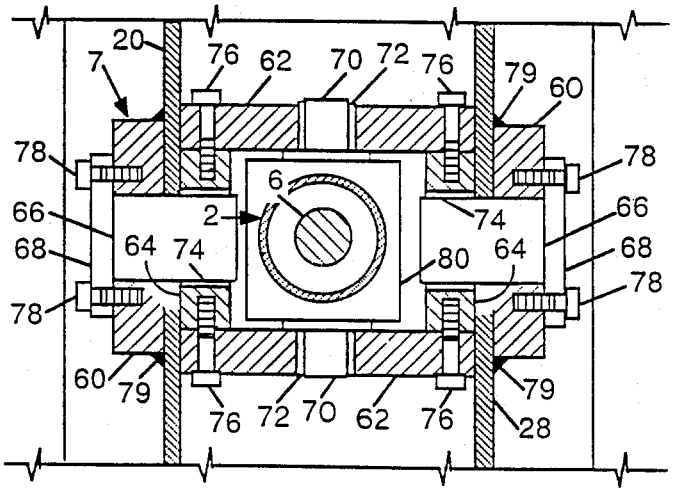
FIG. 3 is a sectional view taken from FIG. 1 illustrating details of a universal joint type swivel mount.

FIG. 3 illustrates a sectional view taken from FIG. 2 of a well known universal joint cylinder mount 7 which will provide the necessary swivel movement at the cylinder to frame connections. The cylinder 2 is provided with a pivotal trunnion mount 70, 80. The pivots 70 may freely rotate in the bushings 72 which function as bearing supports of members 62. Members 62 have attaching means 76 such as bolts to members 64 which is supported through bushings 74 and is allowed to rotate in an axis perpendicular to pivots 70 through the pivots 66. The flange 68 of the pivot 66 has attaching means such as bolts 78 to the members 60. Members 60 are attached to the press frame members 20,28 by means such as a weld 79.

Figure 4:
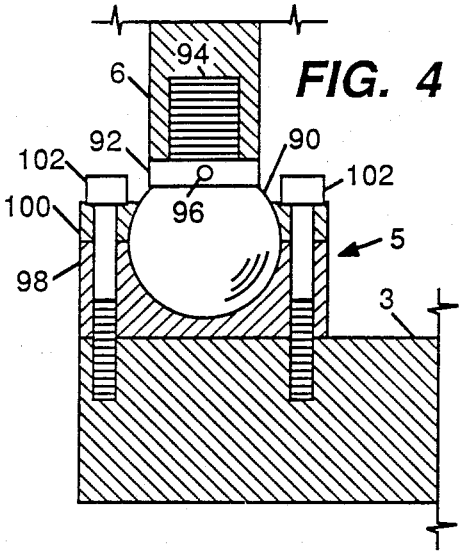
FIG. 4 is a sectional view of a ball and socket type swivel mount that could be used as a cylinder rod to platen connection.

FIG. 4 illustrates a sectional view of a well known ball and socket type mount 5 which will provide the necessary swivel movement at the cylinder rod to platen connections. The ball 90 is attached to the cylinder rod 6 by means such as threads 94. Flange 92 is tightened by means such as a spanner hole 96. The ball 90 rides in a socket formed by members 98,100 and is attached to the platen 3 by means such as bolts 102.

Figure 5:
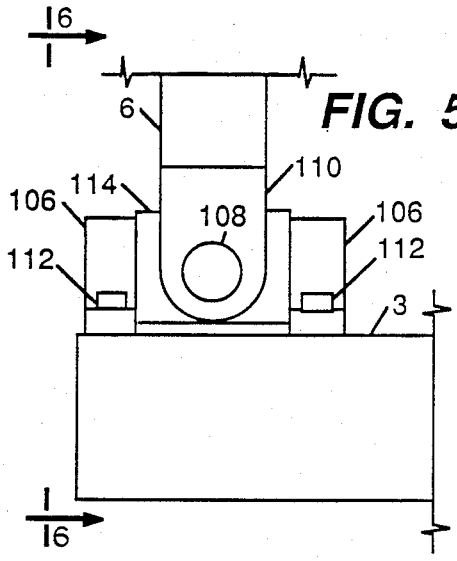
FIG. 5 is an front elevational view of a universal joint type swivel mount that could be used as a cylinder rod to platen connection.
Figure 6:
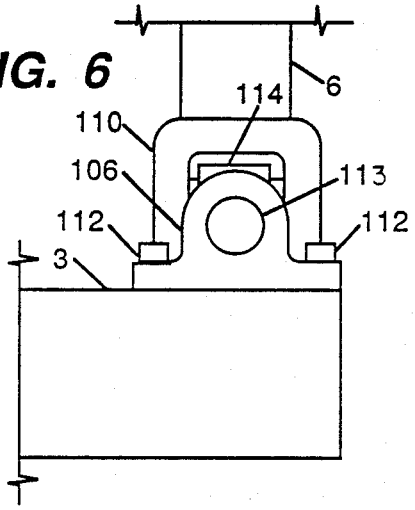
FIG. 6 is side elevational view of the swivel mount taken from FIG. 5.
Figure 7:
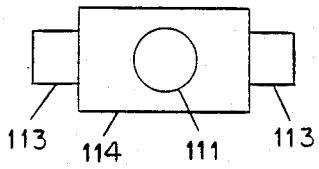
FIG. 7 is a front elevational view of an attachment bar used in FIGS. 5–6.

FIGS. 5–7 illustrate a well known universal joint mount which will provide the necessary swivel movement at the cylinder rod to platen connection. Bracket 110 is shown attached to cylinder rod 6 and has a round shaft 108 extending through the hole 111. Pivots 113 are attached to member 114 and rotate in the bearing supports 106 which has means for attaching to the platen 3 such as bolts 112. This type of mount can be designed to provide more pivotal movement that will the ball and socket illustrated by FIG. 4.

Figure 8:
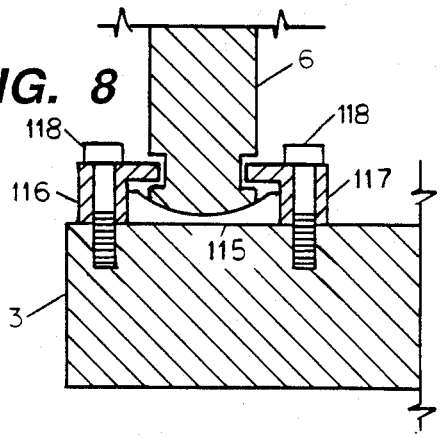
FIG. 8 is a sectional view of a commercially available swivel mount that could be used as a cylinder rod to platen connection.

FIG. 8 illustrates a commercially available swivel mount whereby the cylinder rod 6 has been machined to ride in a socket 115. The assembly is held to the platen 3 by split brackets 116, 117 bolted 118 to the platen 3. This type of mount will typically provide less pivotal movement that either above described mounts, but can sometimes be installed at less cost.

Figure 9:
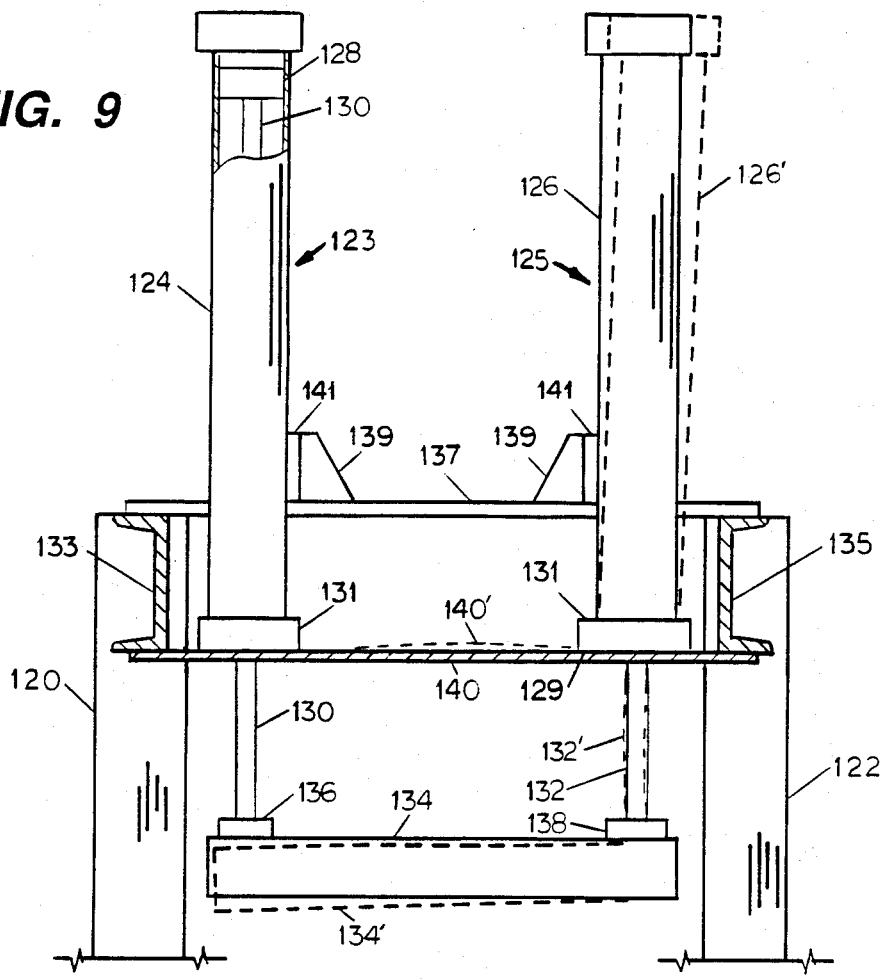
FIG. 9 is a sectional view of a simpler type semi-rigid swivel mount that uses deflection of the mounting plate and cylinder rods to accomplish a limited swivel movement.

Other implementations of the invention include an inexpensive press, as illustrated by FIG. 9, with the cylinders rigidly bolted to the press frame and platen thus saving the expense of the universal joint frame mount and swivel rod to platen connections. The problem of uneven hydraulic fluid flow is compensated for by a flexible, non-rigid platen and cylinder rods that will deflect the expected maximum stroke difference without damage. Other means for protecting the machine from damage in the event of a fluid flow loss to one cylinder may also be used and are outside the scope of this invention.

FIG. 9 illustrates such an inexpensive method for mounting cylinders 123,125 to a press frame when a limited amount of swivel movement is acceptable. Cylinder 123 is comprised of members 124,128,130,131. Similarly cylinder 125 is comprised of members 126,132,138,127. Cylinder heads 131,127 are attached to a plate 140 by means such as welding, bolting, etc. Plate 140 is sized to deflect as shown by the dashed line 140' which allows a swivel movement. 126' illustrates a moved position of cylinder 126 away from the stop 139,141 which is similar to that of FIG. 2 with the more expensive universal joint type mount 7. 134' illustrates a moved position of platen 134 also similar to that of FIG. 2. Cylinder rod to platen connections 136,138 may be either of the types described, or may be a semi-rigid connection attached directly to the platen 134, in which case the required cylinder rod to platen swivel movement is accomplished in part by deflection of the cylinder rod 132 as shown by the dashed lines 132'. While inexpensive, the major disadvantage of this configuration is that some bending moment is introduced into the cylinder rods and press frame limiting the capacity of the press.

All cylinders illustrated by FIGS. 1–2, FIG. 9–11 operate by pressurized hydraulic fluid on one side of a sealed piston such as 128 which moves a cylinder rod as 130.

Figure 10:
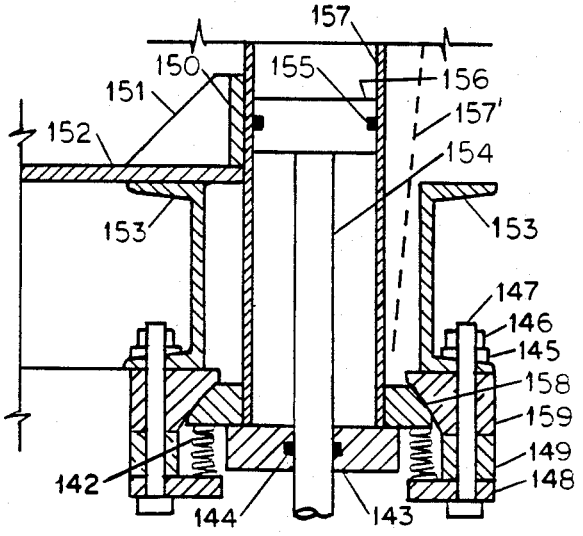
FIG. 10 is a sectional view of a spherical bushing arrangement that can be used to give the required swivel movement at the cylinder to press frame connection.

FIG. 10 illustrates a sectional view of a spherical bushing arrangement that will give the required swivel movement at the cylinder to press connection. A hydraulic cylinder is shown in part comprised from members 143,144,154,155,156,157. Dashed line 157' illustrates the moved position of the cylinder body 157. Member 158 is a spherical bushing attached to the cylinder head 143 and rides in the spherical bushing 159. Springs 142 are sized to keep the spherical connections at 158,159 when no pressure is applied to the top of piston 156. The assembly is held to the press frame by members 148,149 using bolting means 145,146,147. The press frame is illustrated in part by members 153,152. The function of this arrangement is identical to the other described cylinder to press frame swivel mounts with the swivel movement being limited by mechanical stops 150,151 attached to the press frame member 152.

Also shown in FIG. 10 are sealing means 155,144 which are typical for most hydraulic cylinders.

Figure 11:
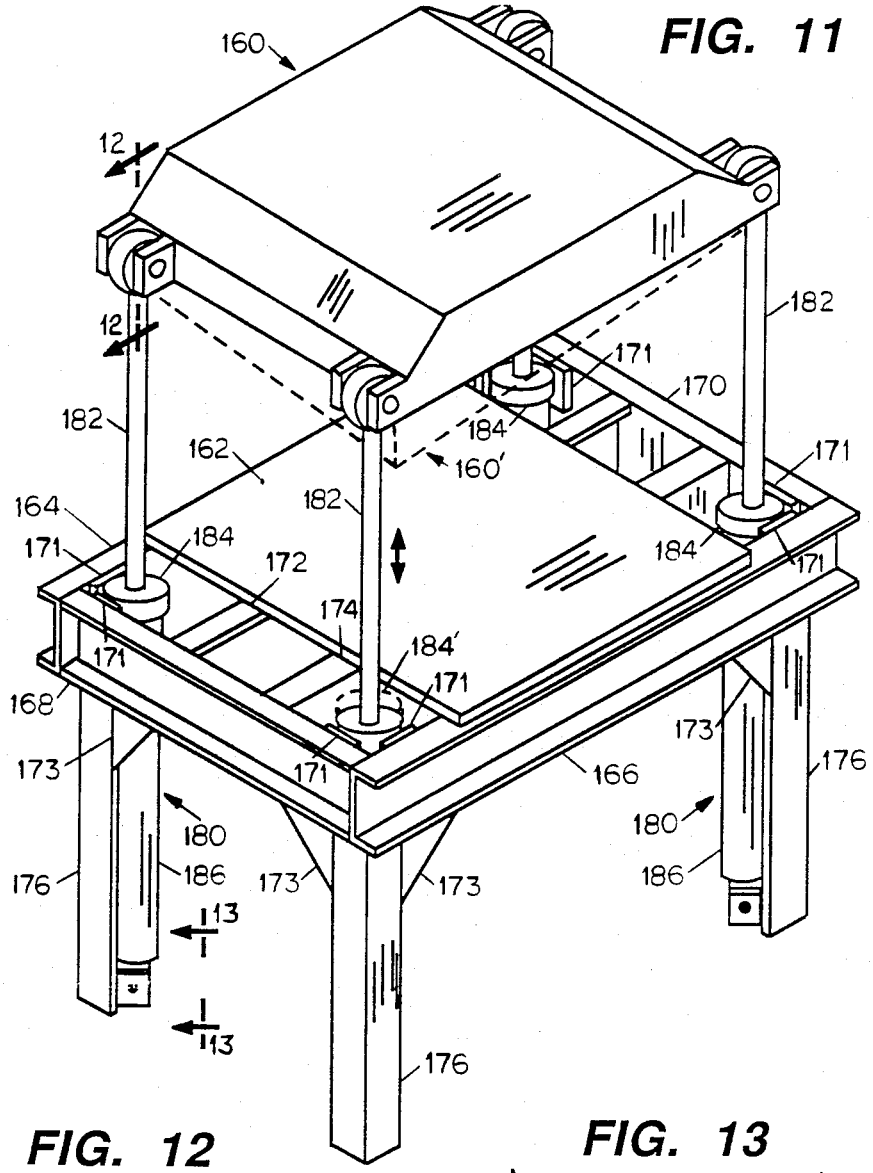
FIG. 11 is a front perspective view of a vertical stroke press using commercially available type swivel cylinder and rod mounts. This embodiment may be used when the cylinders pull the platen against the work.

A useful implementation of the invention on a press is accomplished by connecting the platen to be pulled against the work by the previously extended cylinders illustrated by FIG. 11. As described above, the cylinders may be mounted to the frame with a swivel universal joint type or ball and socket mount and mechanical stops prevent the platen from swinging outside of the envelope seen in the normal level attitude. Commercially available swivel type rod ends may be used to connect the cylinder rods to the platen. The hydraulic operation is identical to that described above. This type of press is useful when the platen does not have to enter a box or open container and has the advantage of a smaller and less expensive frame size. Such a press has the cylinders mounted in each of the press legs with the platen raised by extending the rods vertically, and pulled against the work by retracting the cylinders. Such a press does not require any supporting frame structure above the platen as the cylinder rods alone provide the platen supports. A scrap automobile compactor would be made this way as well as a smaller machine to flatten horizontally placed 55 gallon barrels, or a forming press.

FIG. 11 illustrates the alternative embodiment of the present invention with the cylinders connected to pull against the work. The press frame is comprised from structural members 162,171,172,173,174,176. The platen 160 is shown normally and as tilted due to an unequal flow division by dashed lines 160'. A hydraulic fluid pumping means, plumbing means, and flow dividing means are omitted from this illustration for clarity but are of identical function as 11,12,14,16 of FIG. 1. The cylinders 180 are shown comprised from members 182,184,186, and 212. Stop means 171 are mounted on the press frame to prevent the cylinders 180 from freely swiveling and are also functionally the same as 4,5 of FIG. 1.

Figure 12:
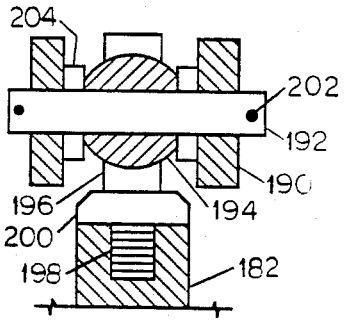
FIG. 12 is a sectional view taken from FIG. 11 and illustrates the cylinder rod to platen connection using commercially available rod end swivel mounts.

FIG. 12 illustrates a commercially available swivel rod end to platen connection comprised from members 192,194,196,198,200,202,204 connected to brackets 190 of the platen 160. The flange 200 is attached to the cylinder rod 182 by means such as threads 198. The spherical bushing 196 is also attached to flange 200 and rides over a ball 194 to provide the required swivel movement. Ball 194 has a connecting shaft 192 to the platen brackets 190 and has means for holding in place such as pins 202. Spacers 204 allow for a larger swivel movement of the assembly.

Figure 13:
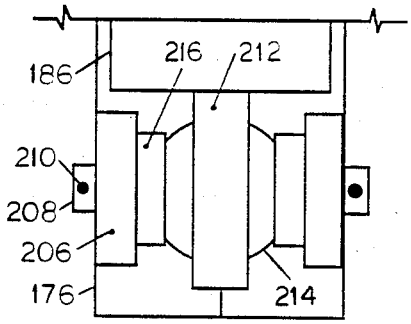
FIG. 13 is a detailed view taken from FIG. 11 and illustrates the cylinder to press frame connection using commercially available swivel mounts.

FIG. 13 illustrates a commercially available cylinder to press frame swivel mount that functions identically to that of FIG. 12. The cylinder body 186 has a spherical bushing 212 that rides over a ball 214 to provide the required swivel movement. The ball 214 has a shaft 208 through it and the brackets 206 that have means for attaching to the press frame 176 here shown as a structural angle. The shaft 208 has means for retaining such as pins 210. Spacers 216 allow for a larger swivel movement of the assembly. A section taken through this assembly could appear identical to FIG. 12 except for being connected to the press frame instead of the platen.

Figure 14:
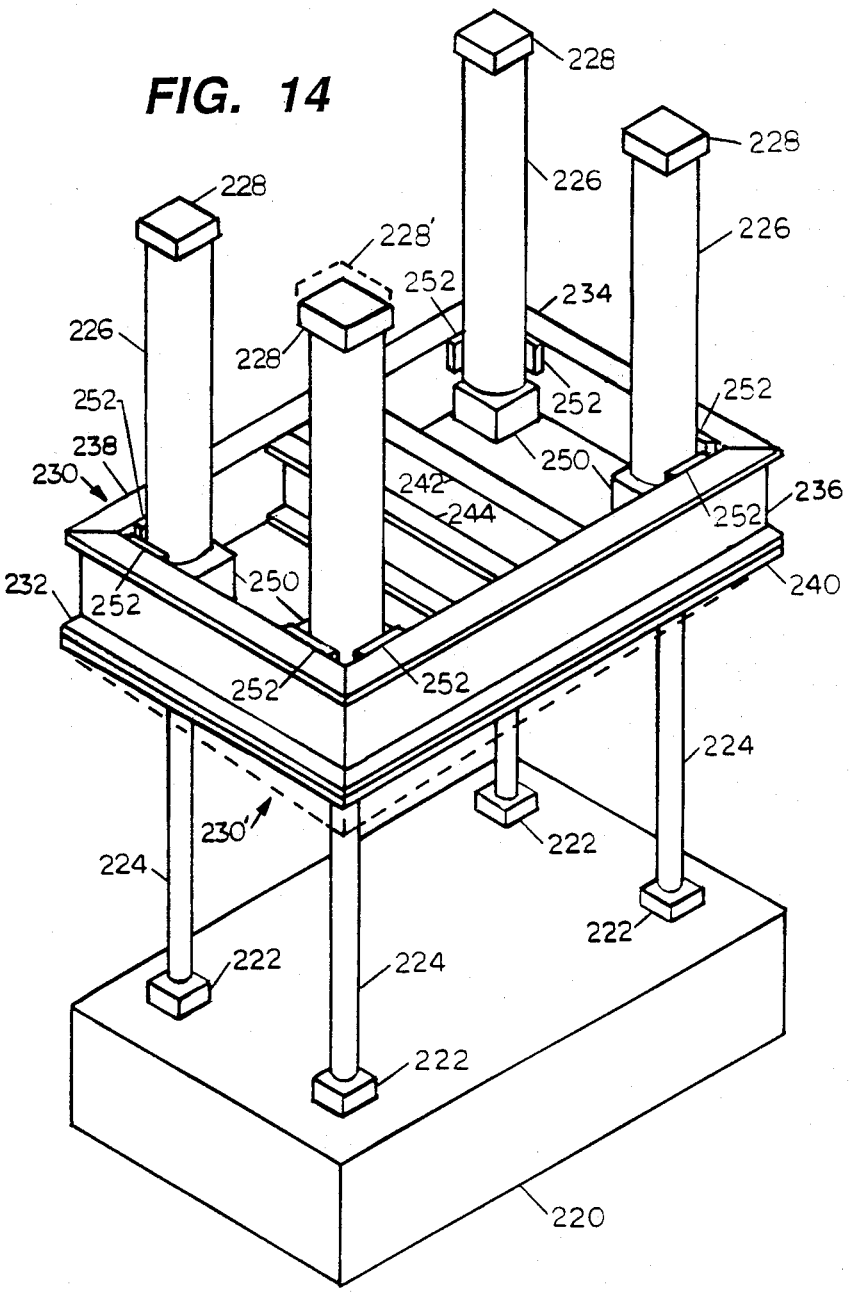
FIG. 14 is an alternative embodiment whereby the cylinders are connected to the platen and pull the platen against the work.

FIG. 14 illustrates an alternative embodiment whereby the cylinder bodies 226 are swivel mounted to the platen 230 instead of the press frame 220. The advantage of this arrangement is that a press with a small frame height may be used. The embodiment of FIG. 14 will pull the platen 230 against the work similar to FIG. 11. The cylinder to platen swivel connections are represented by 250 and may be of either type described hereby. The cylinder rod to press frame swivel connections are represented by 222 and may also be of either type described hereby. The press platen 230 is illustrated as being fabricated from members 232,234,236,238,240,242,244. The platen in a tilted position is represented by 230'. The required mechanical stops are represented by 252 and allow the cylinders to pivot inward as shown by 228'. The cylinders are comprised from members 226,228 and cylinder rods are 224. The required hydraulic pumping means, plumbing means, and flow dividing means are not shown but are functionally identical to that of FIG. 1 items 11,12,14,16.

Either of the described cylinder rod to platen connections or cylinder to press frame connections may be used in either embodiment of the present invention to achieve the required swivel movements.

A precision implementation of the invention is accomplished using one of the recently commercially available electronic piston position monitors as part of the flow dividing means 12 illustrated by FIG. 1, to electronically determine if one cylinder rod has extended further than another. The hydraulic fluid flow to the overextended cylinder is stopped until the other cylinders catch up. This has the advantage of allowing a precise control of the platen attitude and may be used in a design such as a forming press. The advantage of using the present invention is that the cylinders with this implementation need not be mounted to extend parallel, as with a typical press design, to assure that the rods do not bind when extended. The precision of the implementation is achieved with very closely equal volumes of hydraulic fluid from the flow dividing means 12.

The above described implementations of the invention can be used with either a double acting hydraulic cylinder that can be activated by extending or retracting the cylinder rod, or with a less expensive single acting cylinder that is extended with hydraulic fluid and retracted by other means such as a spring return. The retracting means may be incorporated with the cylinders 2 illustrated by FIG. 1, the function of the invention is the same with either type cylinder.

From the foregoing description of the operation of the hydraulic press platen support, it should be apparent that a platen support is provided which provides a technique for effectively dealing with the bending moments encountered when a platen is subjected to loads off of its geometric center.

Having illustrated and described what is presently the preferred embodiments of the invention, it should be apparent to those skilled in the art that the preferred embodiments may be modified in arrangement and detail without departing from the principles of the invention which are intended to be illustrated but not limited by the disclosure. We therefore claim as our invention all such modifications as come within the true spirit and scope of the following claim.

We claim:

1. In a hydraulic press having a press frame, at least four hydraulic cylinders mounted to said press frame, a cylinder rod in each of said cylinders, a platen supported by said cylinder rods, a hydraulic fluid pumping means, and a hydraulic flow dividing means providing near equal hydraulic flow to activate each of the cylinders, a platen support arrangement comprising:

a swivel joint connection between each of said cylinders and said press frame, said swivel joint connections thus allowing pivotal movements in directions perpendicular to the longitudinal axis of said cylinders;

a swivel joint connection between each of said cylinder rods and said platen, said swivel joint connections thus allowing pivotal movement in directions perpendicualr to the longitudinal axis of said cylinders; and stop means located on said press frame for restraining said hydraulic cylinders, thus limiting swivel movement.

2. In a hydraulic press having a platen, at least four hydraulic cylinders connected to said platen, a cylinder rod in each of said cylinders, a frame, a hydraulic fluid pumping means, and a hydraulic flow dividing means providing near equal hydraulic flow to activate each of the cylinders, a platen support arrangement comprising:

a swivel joint connection between each of said cylinders and said press platen, said swivel joint connections thus allowing pivotal movement in directions perpendicular to the longitudinal axis of said cylinders;

a swivel joint connection between each of said cylinder rods and said press frame, said swivel joint connections thus allowing pivotal movement in directions perpendicular to the longitudinal axis of said cylinders;

stop means located on said press platen for restraining said hydraulic cylinders, thus limiting swivel movement.

* * * * *